US011808546B2

(12) United States Patent
Cadenasso et al.

(10) Patent No.: US 11,808,546 B2
(45) Date of Patent: Nov. 7, 2023

(54) AIMING APPARATUS FOR A FIREARM

(71) Applicant: Trajectory, LLC, Minden, NV (US)

(72) Inventors: Jerome Anthony Cadenasso, Lancaster, CA (US); Steven Worden Cadenasso, Paso Robles, CA (US)

(73) Assignee: TRAJECTORY, LLC, Minden, NV (US)

( * ) Notice: Subject to any disclaimer, the term of this patent is extended or adjusted under 35 U.S.C. 154(b) by 0 days.

(21) Appl. No.: 17/572,514

(22) Filed: Jan. 10, 2022

(65) Prior Publication Data

US 2022/0228839 A1 Jul. 21, 2022

Related U.S. Application Data

(60) Provisional application No. 63/138,570, filed on Jan. 18, 2021.

(51) Int. Cl.

| | |
|---|---|
| ***F41G 1/35*** | (2006.01) |
| *F41G 1/473* | (2006.01) |
| *F41G 11/00* | (2006.01) |

(52) U.S. Cl.

CPC ..... *F41G 1/35* (2013.01); *F41G 1/473* (2013.01); *F41G 11/003* (2013.01)

(58) Field of Classification Search

CPC ..... F41G 1/35; F41G 1/473; F41G 11/003
USPC ..... 42/114
See application file for complete search history.

(56) References Cited

U.S. PATENT DOCUMENTS

| | | | | |
|---|---|---|---|---|
| 7,784,192 | B2 * | 8/2010 | Jancic | F41G 1/35 33/286 |
| 8,683,731 | B2 * | 4/2014 | Kowalczyk | F41G 1/36 42/114 |
| 9,291,430 | B2 * | 3/2016 | Clark | F41G 1/35 |
| 9,909,830 | B1 * | 3/2018 | Toole | F41G 1/35 |
| 2008/0276473 | A1 * | 11/2008 | Raschella | G01C 15/004 33/286 |
| 2013/0145672 | A1 * | 6/2013 | Tuller, Jr. | F41G 11/001 42/114 |
| 2018/0292169 | A1 * | 10/2018 | Tuller | F41G 1/35 |
| 2022/0228839 | A1 * | 7/2022 | Cadenasso | F41G 1/35 |

* cited by examiner

*Primary Examiner* — Samir Abdosh
(74) *Attorney, Agent, or Firm* — Bennet K. Langlotz; Langlotz Patent & Trademark Works, LLC

(57) ABSTRACT

An aiming apparatus for a firearm has a frame, a plurality of visible and/or invisible light generators connected to the frame, with each light generator operable to propagate planar and/or non-planar light in the forward direction. Each light generator utilizes shaping optics to create straight or curved lines of light. Straight lines of light propagating in a forward direction will create a plane of light, while curved lines of light propagating in a forward direction will create non-planar light. A plurality of planar light oriented in a non-parallel, overlapping relationship creates a straight intersection line of light, while a plurality of non-planar light orientated in a non-parallel, overlapping relationship creates a straight or curved intersection line of light. When projected against a target surface, a plurality of planar lights creates a projected cross shape, which may have an intersection point.

20 Claims, 9 Drawing Sheets

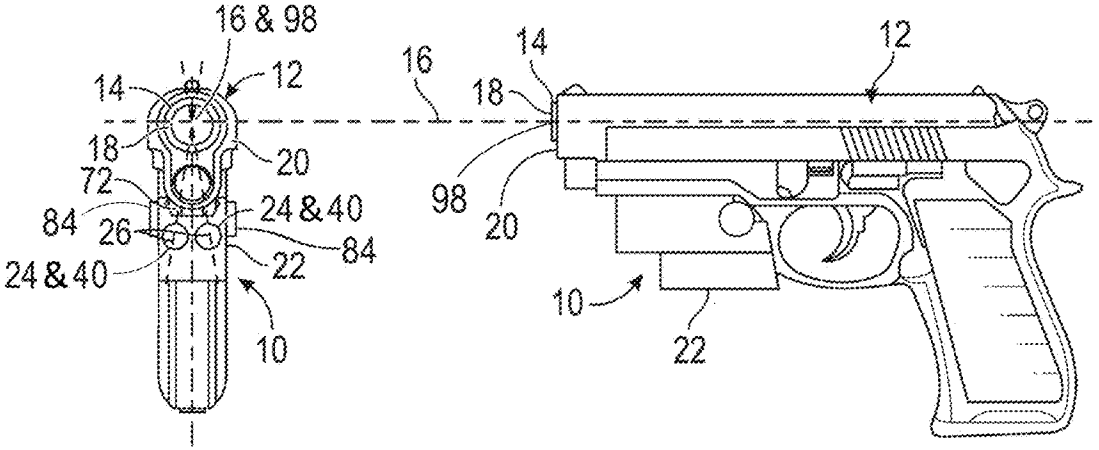
FIG. 1
FIG. 2
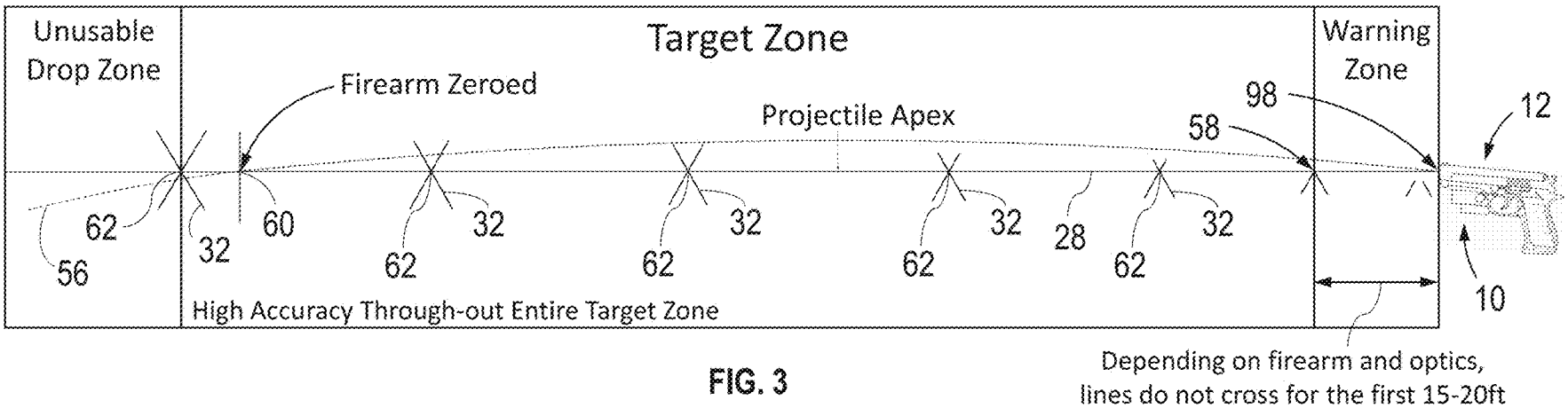
FIG. 3

AIMING APPARATUS FOR A FIREARM

CROSS-REFERENCE TO RELATED APPLICATION

This application claims the benefit of U.S. Provisional Patent Application No. 63/138,570 filed on Jan. 18, 2021, entitled "X-STREAM, FIREARM TARGETING TECHNOLOGY," which is hereby incorporated by reference in its entirety for all that is taught and disclosed therein.

FIELD OF THE INVENTION

The present invention relates to firearms, and more particularly to an aiming apparatus for firearms that provides high accuracy throughout the entire target zone. The term "entire target zone" refers to an area that is from the firearm's muzzle exit point to a target distance several feet beyond the firearm's zero point.

BACKGROUND AND SUMMARY OF THE INVENTION

A variety of laser targeting apparatuses have been developed to facilitate the aiming of a firearm. A conventional aiming apparatus mounted to a firearm employs a single laser dot generator to project a column of light downrange to a predicted point of impact. This beam of light is adjusted in elevation (vertically) and in azimuth (horizontally) to match a specific projectile's flight characteristics to a point of impact at a predefined distance. This adjustment is referred to as "zeroing the firearm."

The inherent disadvantage of conventional concepts and designs of the prior art is the single laser dot generator is mounted offset from the firearm's barrel axis. This offset has built-in inaccuracy throughout the entire target zone. When a conventional aiming apparatus is attached to the top of the firearm, the laser dot will have only two points where it intersects the projectile's trajectory (one before the projectile reaches its apex and one at the firearm's zero point). For any other mounting orientations (bottom/side), the laser dot is accurate only at the firearm's zero point.

However, depending on the projectile's initial velocity and the firearm's distance to target, a majority of the projectile's trajectory could be offset by several inches from where the laser dot is located. So, switching from one target distance to another can adversely affect accuracy when it is impractical to adjust the aiming apparatus between targets.

In a different industry, a pair of planar light generators have been used to create an intersection of light registered with the axis of a drill press bit to visually convey where the bit will drill a hole on a connected workpiece. However, this application does not attempt to approximate the curved path of a gravity-affected projectile. Furthermore, this application is intended for use within a few feet of where the planar light generators are mounted rather than projecting a location on an object at a substantial distance.

Therefore, a need exists for a new and improved aiming apparatus for a firearm that provides high accuracy throughout the entire target zone. In this regard, the present invention with all the various embodiments, substantially depart from the conventional concepts and designs of prior art. Developed primarily for improving firearm aiming, the aiming apparatus for a firearm overcomes the above-mentioned disadvantages and drawbacks of the prior art. As such, the general purpose of the present invention, which will be described subsequently in greater detail, is to provide an improved aiming apparatus for a firearm that has all the advantages of the prior art mentioned above. In doing so, the present invention provides a highly accurate targeting system for any point within the entire target zone.

Each embodiment of the present invention utilizes two or more visible or invisible light generators that conventional aiming apparatuses use. However, the present invention adds shaping optic(s), optic coating(s) and/or optic etching(s) to each light generator, expanding the dot in one direction and creating a line of light (straight line) when projected onto a surface. The addition of other shaping optic(s), optic coating(s) and/or optic etching(s) can transform a straight line of light into a curved line of light when projected onto a surface. These light generators propagate a plane of light (straight line) or non-planar light (curved line) downrange from the host firearm.

To attain a more accurate targeting system, the preferred embodiment of the present invention essentially comprises a frame, a plurality of planar light generators connected to the frame, projecting forward in a non-parallel orientation, create intersecting planes of light. This intersection of light is aligned to the exit point of the firearm's muzzle axis. When projected against a target surface, the intersection of light appears as a cross, predicting a point of impact for the zeroed host firearm.

Other embodiments utilize a plurality of planar and/or non-planar light generator combinations connected to the frame. Planar lights align with the exit point of the firearm's muzzle axis, while non-planar lights can be aligned with or concentric to the exit point of the firearm's muzzle axis.

Other embodiments utilize a plurality of non-planar light generators aligned so the intersection of light will be at different elevations throughout the entire target zone, thereby adjusting the elevation of the intersection of light to closely match the projectile's trajectory path.

The present invention's intersection of light is aligned to both the exit point of the firearm muzzle axis and the predicted impact point of the target, effectively drawing a line of aim through both points. Because of to the geometry between the intersection of light and the projectile's trajectory, the intersection of light is more accurate at each end of the projectile's flight path and is less accurate at the center or apex of the projectile's trajectory.

Thus, the greater the projectile's velocity and/or the shorter the target distance, the shallower the trajectory arc. This in turn reduces the projectile's apex height, increasing the accuracy of the present invention's intersection of light throughout the entire target zone. There are, of course, additional features of the invention that will be described hereinafter and which will form the subject matter of the claims attached.

There has thus been outlined, rather broadly, the more important features of the invention in order that the detailed description thereof that follows may be better understood, and in order that the present contribution to the art may be better appreciated.

BRIEF DESCRIPTION OF THE DRAWINGS

FIG. 1 is a front view of the current embodiment of an aiming apparatus for a firearm constructed in accordance with the principles of the present invention in use attached to a pistol.

FIG. 2 is a left side view of the aiming apparatus for a firearm of FIG. 1 in use attached to a pistol.

FIG. 3 is a schematic showing how the planar light generators of the aiming apparatus for a firearm of FIG. 1 generate a projected intersection of light at locations closely approximating the projectile's curved path fired by the pistol.

Figure 4:
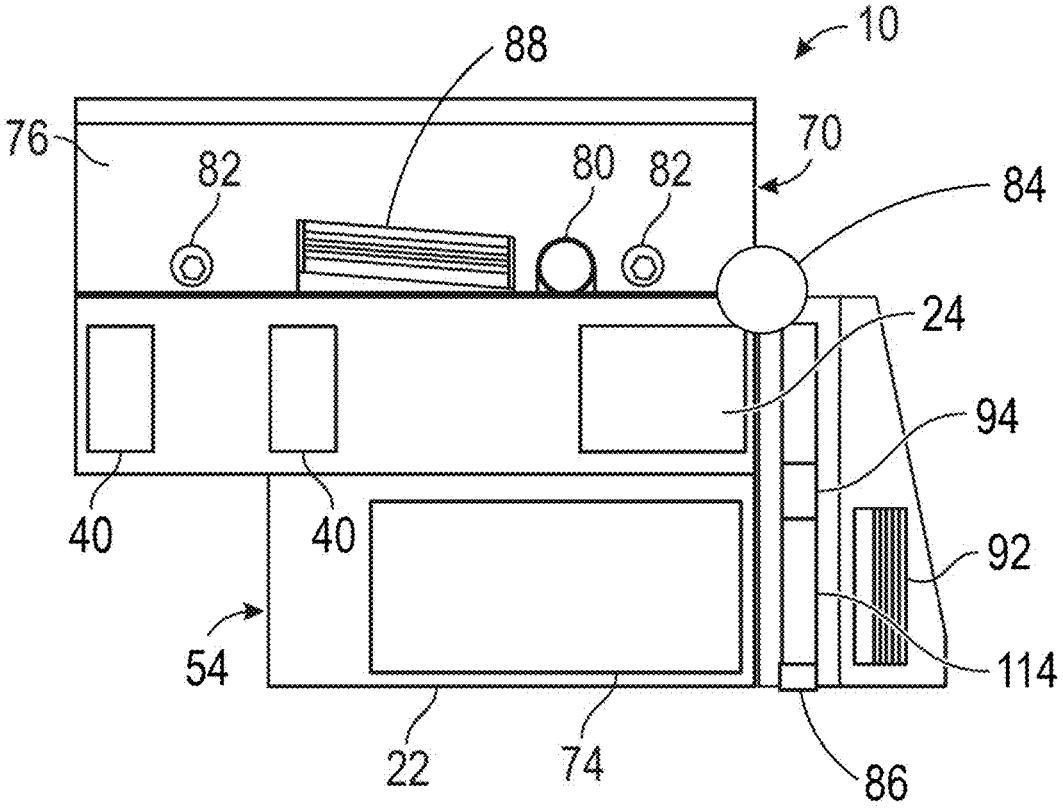

FIG. 4 is a schematic of the aiming apparatus for a firearm of FIG. 1.

Figure 5C:
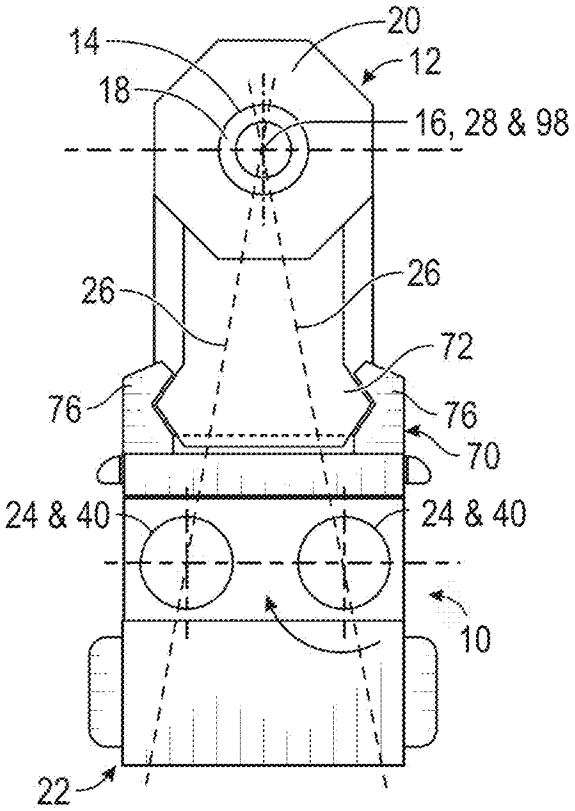
Figure 5B:
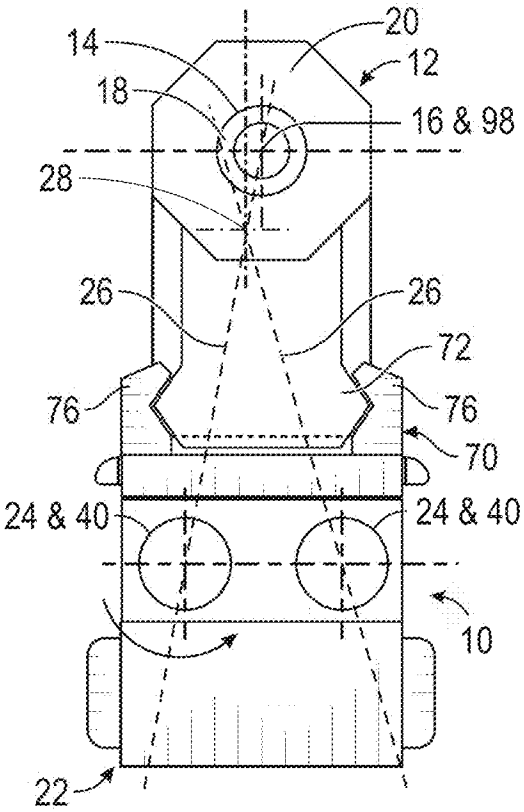
Figure 5A:
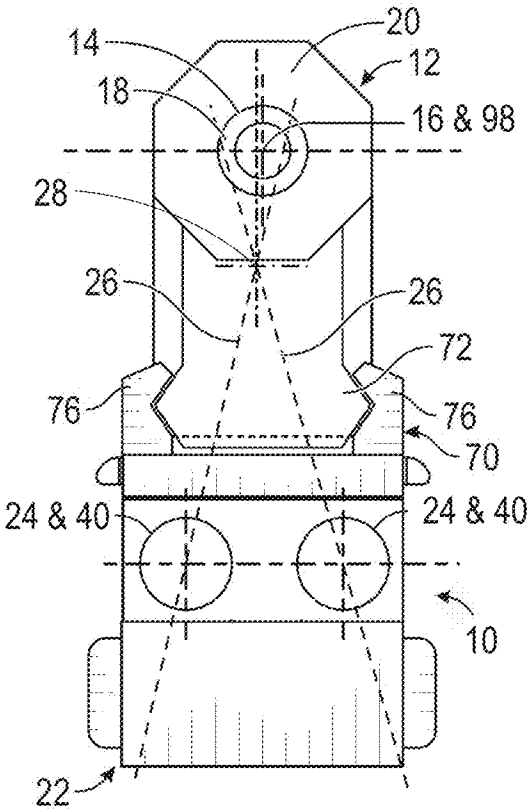

FIG. 5A is a front view of the aiming apparatus for a firearm of FIG. 1 in use attached to a pistol with both of the planar light generators not aligned to the exit point of the firearm's muzzle axis.

FIG. 5B is a front view of the aiming apparatus for a firearm of FIG. 1 in use attached to a pistol with one of the planar light generators aligned to the exit point of the firearm's muzzle axis and one of the planar light generators not aligned to the exit point of the firearm's muzzle axis.

FIG. 5C is a front view of the aiming apparatus for a firearm of FIG. 1 in use attached to a pistol with both of the planar light generators aligned to the exit point of the firearm's muzzle axis.

Figure 6:
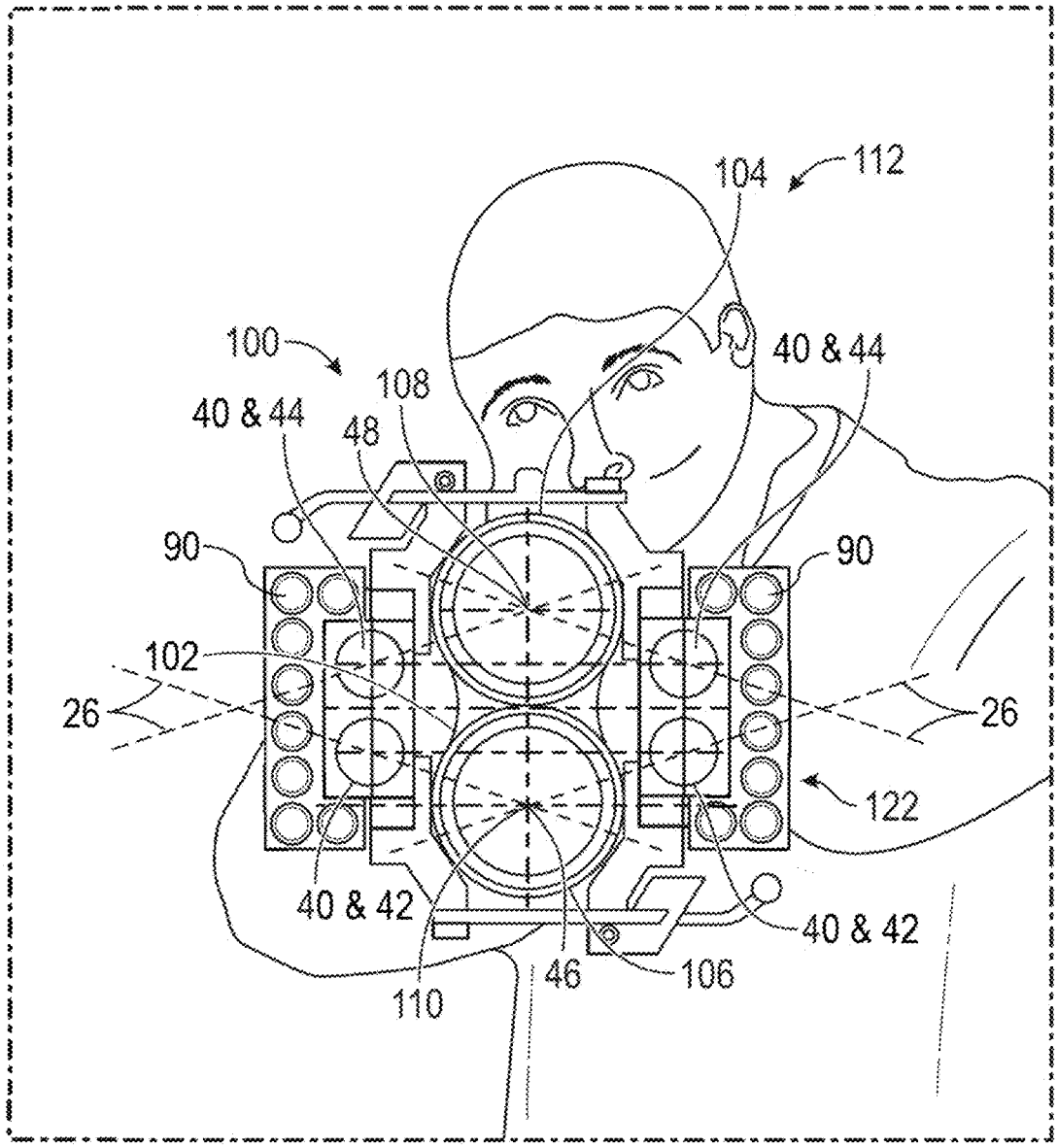

FIG. 6 is a front view of an alternative embodiment of the aiming apparatus for a firearm having two pairs of planar light generators in use attached to an over/under shotgun.

Figure 7:
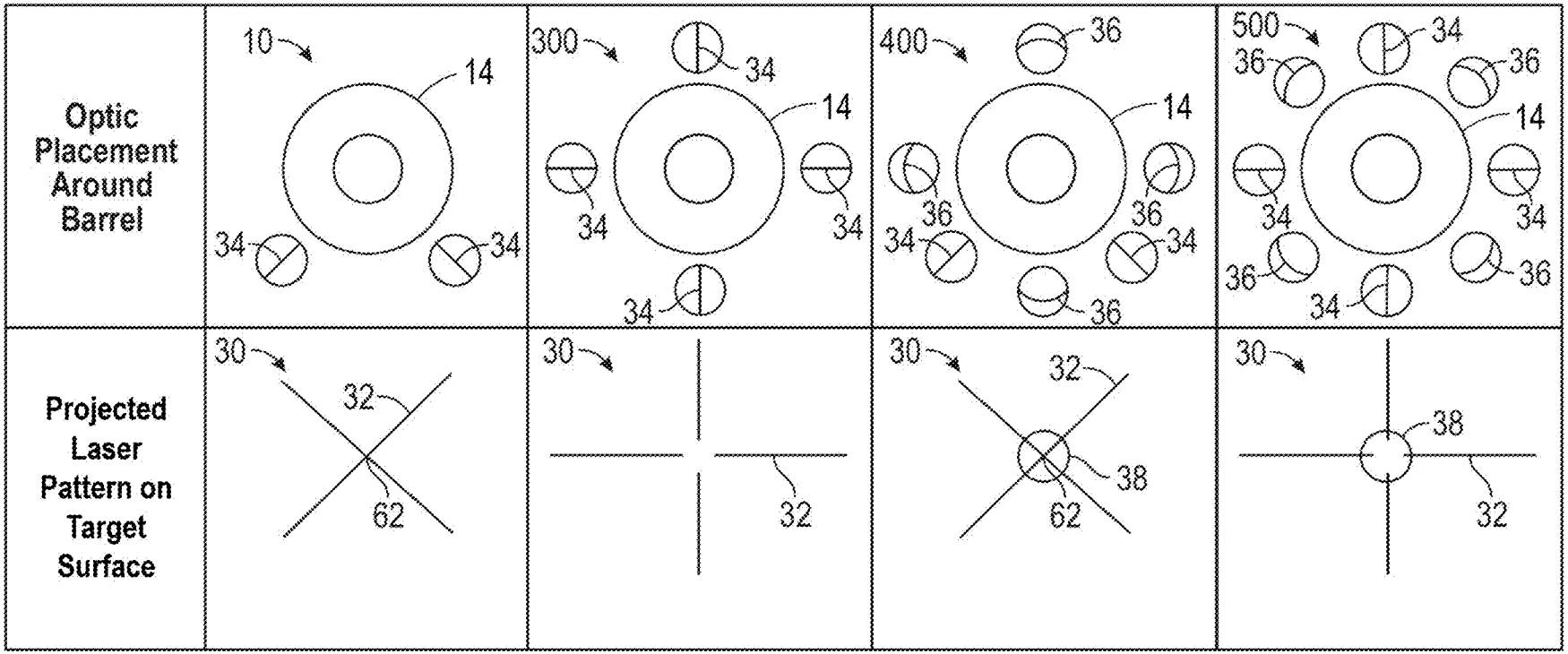

FIG. 7 is a schematic of the projected shapes resulting from embodiments having various arrangements of planar light and non-planar light generators propagating flat and curved light, respectfully.

Figure 8:
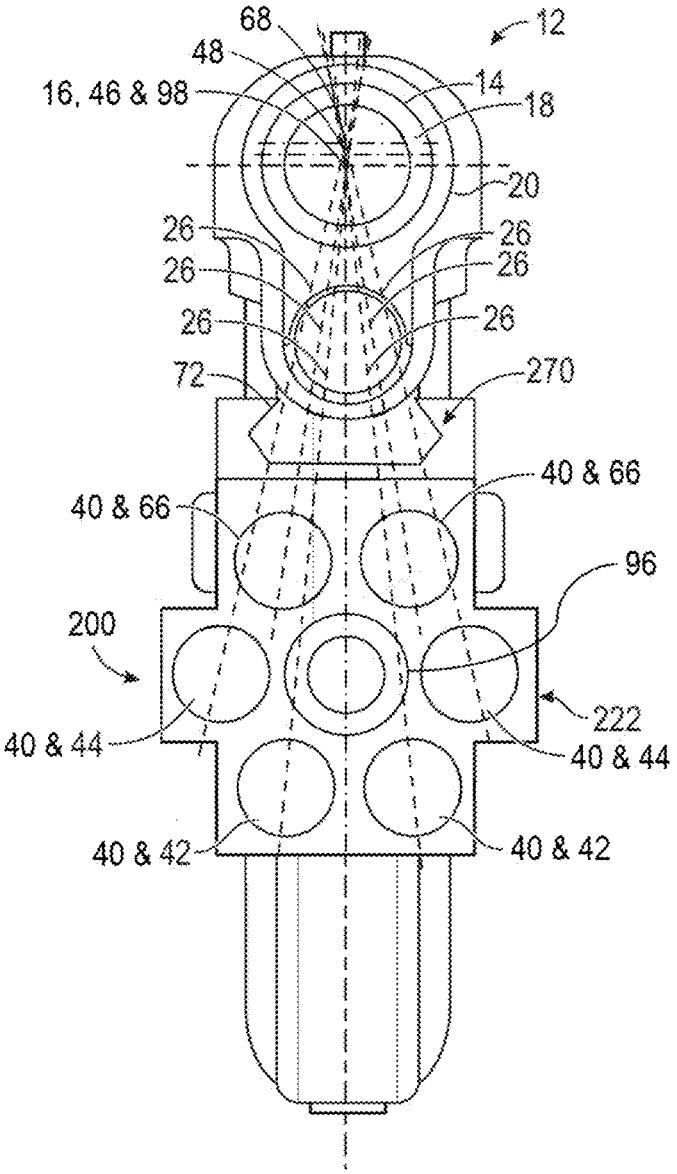

FIG. 8 is a front view of a second alternative embodiment of the aiming apparatus for a firearm having three pairs of light generators in use, attached to a pistol. The second alternative embodiment utilizes a range finder and applies power to the closest intersection of light (set of line generators) for a specific projectile trajectory.

Figure 9:
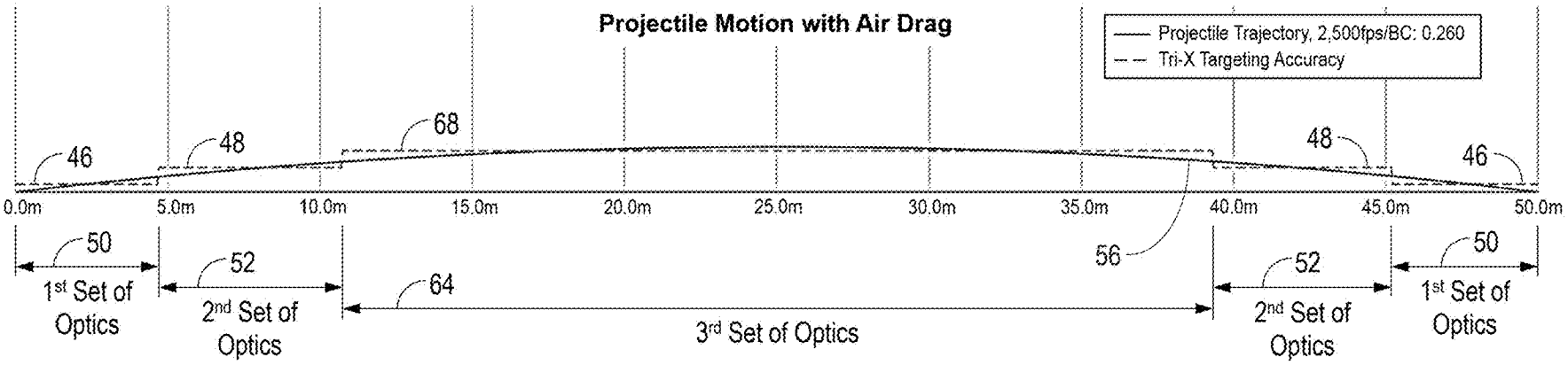

FIG. 9 illustrates a stairstep mapping of the three projected intersection lines of FIG. 8, overlayed on a projectile's trajectory.

Figure 10:
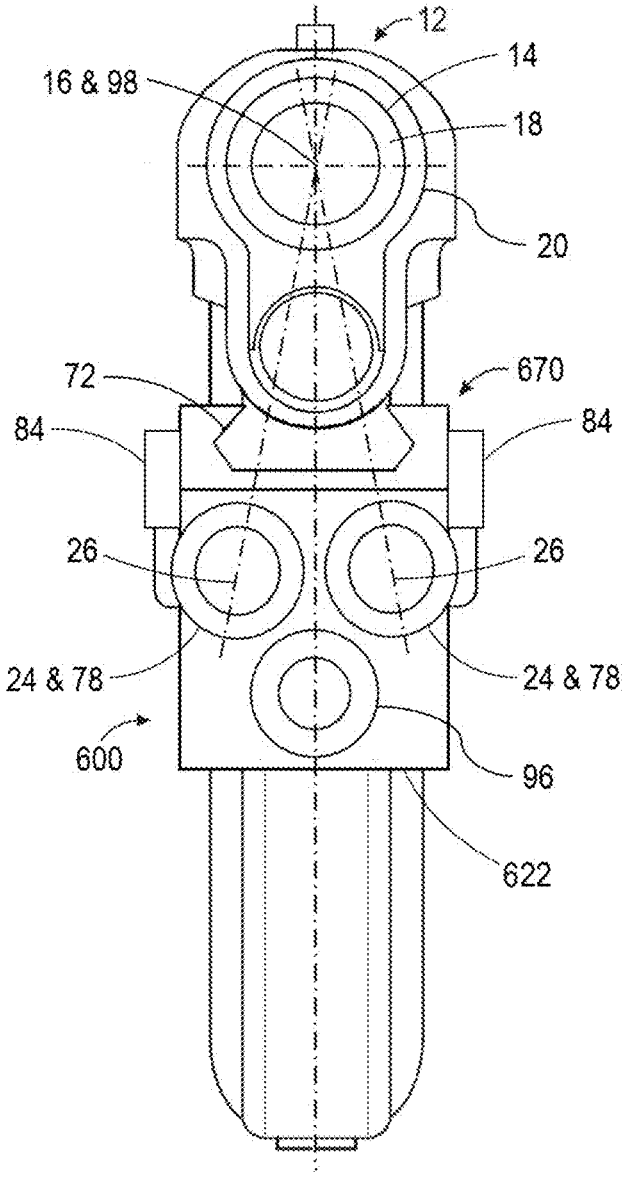

FIG. 10 is a front view of a third alternative embodiment of the aiming apparatus for a firearm attached to a pistol. The third alternative embodiment has a pair of optical motors to rotate each light generator's shaping optics. The third alternative embodiment utilizes a range finder and adjusts the intersection of light's (set of line generators) location relative to the projectile's performance data, thereby predicting a point of impact throughout the entire flight path.

Figure 11:
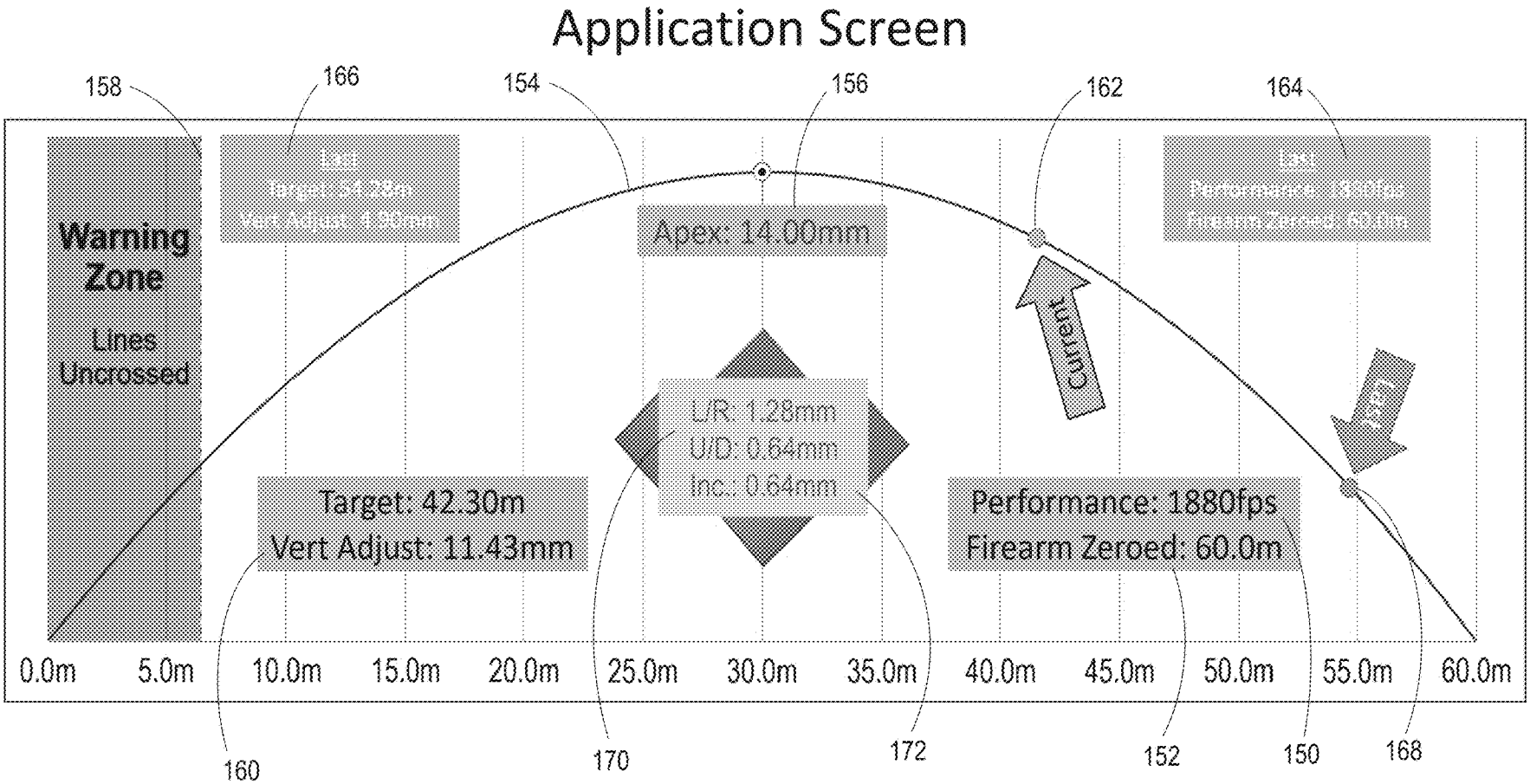

FIG. 11 illustrates a schematic of an application screen corresponding the flight data and predicted point of impact described in FIG. 10.

The same reference numerals refer to the same parts throughout the various figures.

DESCRIPTION OF THE CURRENT EMBODIMENT

An embodiment of the aiming apparatus for a firearm of the present invention is shown and generally designated by the reference numeral 10.

FIGS. 1, 2 & 4 illustrate the improved aiming apparatus 10 for a firearm 12 of the present invention, and FIG. 3 illustrates how the improved aiming apparatus increases accuracy throughout the entire target zone, which is defined by a projectile's path 56. More particularly, FIGS. 1 & 2 show the aiming apparatus for a firearm in use attached to a firearm 12 having a barrel 14 defining a barrel axis 16 and terminating in a muzzle 18 at a forward end 20. In the current embodiment, the firearm is a pistol. The aiming apparatus 10 for a firearm has a frame 22 with a plurality of planar light generators 24 and shaping optics 40 connected to the frame. Each of the planar light generators is operable to project planar light 26 in a forward direction. The shaping optics 40 are oriented with the planar lights in a non-parallel relationship to each other. This intersection of planar lights creates intersection line 28 as shown in FIG. 3, propagating in the forward direction. When projected against a target surface 30 as shown in FIG. 7, the planar lights form a projected cross shape 32 having an intersection point 62. The intersection points 62 are part of intersection line 28 in FIG. 3. As is shown in FIG. 3, the intersection line closely approximates the projectile's path, within the range defining the entire target zone. It should be appreciated that the planar lights 26 do not generate a complete projected cross shape when the target surface is at close range, typically less than 20 ft. away, depending on the characteristics of the optic prescription and host firearm. Non-crossing lines can serve as a "warning zone" to the user that the target is too close for adequate reaction time. It should also be appreciated that the uncrossed planar lights point to the intersection's center where the projectile should closely impact. Beyond the target zone, the projectile path diverges sufficiently from intersection line 28 to define an unusable drop zone. Here, the projected cross shape and intersection line no longer represent the projectile path with adequate accuracy to be useful.

In a separate embodiment, it should be appreciated that with a change of optics, light generators can propagate non-planar light (a curved line traveling through space). When aligned to the exit point of the firearm's muzzle 98 shown in FIG. 3, the non-planar light generators are located on the firearm 12 near the barrel 14 to define a curved projectile trajectory path 56. Each set of optics is removable and can be exchanged with a different optic prescription to match a different projectile's flight characteristics. Each set of optics is designed to match a specific projectile's flight profile. All optic sets are designed to imitate a projectile's flight path 56 for a specific distance, passing through the points where the non-planar lights expand enough in length to touch intersection point 58 and a target's predicted point of impact 60. Certain optic prescriptions for non-planar lights (curved lines propagating through space) create an intersection line 28 that is curved.

FIG. 4 illustrates the improved aiming apparatus 10 for a firearm of the present invention. More particularly, the aiming apparatus for a firearm includes a rail interface region 70 attached to the frame 22 and a control facility 54 contained within the frame. The rail interface region 70 is releasably connected to a picatinny rail 72 formed by the underside of the firearm 12 near the barrel 14. The rail interface region may include two retaining plates 76. A return spring 80 (which can be a compression spring or a torsional spring) provides pressure against a rail release latch 88, pressing and securely locking the rail release latch into the rail 72. The rail interface region also includes four horizontal alignment set screws 82 and dual vertical adjustment knobs 84. It should be appreciated that vertical and horizontal adjustments can be made using any suitable assortment of set screws, knobs and/or levers. The control facility is suitable for ambidextrous use and includes two power buttons 92, an electronic board 114, two recharging contacts 86, and two power indicators 94. In the current embodiment, the power indicators illuminate red to indicate a charge is needed and illuminate blue to indicate fully charged. The control facility also includes batteries 74, a plurality of light generators 24, and shaping optics 40. It should be appreciated that the shaping optics may include up to twelve optics and eighteen alignment/adjustment/focusing features.

FIGS. 5A-C are identical images, except for the shaping optics' 40 rotational position. FIGS. 5A-C illustrate how the shaping optics 40 of the improved aiming apparatus 10 are aligned to a firearm 12 of the present invention, by rotating clockwise or counterclockwise, to align each emitted planar light 26 to pass through the exit point of the muzzle axis 98. FIG. 5A shows both sets of shaping optics 40 misaligned, with neither planar light 26 passing through the muzzle axis exit point 98. In FIG. 5B, the left shaping optics have been rotated counterclockwise relative to the position shown in FIG. 5A so the planar light emitted by the left shaping optics passes through the muzzle axis exit point. In FIG. 5C, the right shaping optics have been rotated clockwise relative to the position shown in FIG. 5A so the planar light emitted by the right shaping optics passes through the muzzle axis exit point. It should be appreciated that when both planar lights pass through the muzzle axis exit point 98, the crossing planar lights 26 create the intersection line 28 extending in the forward direction.

The planar lights 26 can be adjusted relative to each other by rotating the shaping optics 40. Changing the angular relationship between each planar light will alter the intersection lines' 28 position in space, creating a lateral offset relative to the exit point of the muzzle axis 98. In the context of the specification, "lateral" is used broadly to include any offset, in any direction away from or towards the exit point of the muzzle axis, including to the right or left, up or down, or any combination thereof. A plurality of set screws enables the user to secure each set of shaping optics in a selected position.

FIG. 6 illustrates an alternative embodiment of the improved aiming apparatus 100 for a firearm of the present invention. More particularly, the aiming apparatus 100 for a firearm is suitable for use with an over/under shotgun 102 having an upper barrel 104 and a lower barrel 106. The upper barrel defines an upper barrel axis 108, and the lower barrel defines a lower barrel axis 110. The over/under shotgun is shown in use by a user 112. The aiming apparatus for a firearm 100 consists of two identical subassemblies, one oriented and secured 180° relative to the other, shown to the left and right of the over/under shotgun barrels. Each subassembly includes a frame 122 that connects to the upper and lower barrels. Each frame contains a plurality of planar light generators 40 and shaping optics 42, 44, which are oriented to project planar lights 26 in the forward direction, crossing each barrel's axis. The upper two light generators 44 combine to create an intersection line 48, which is aligned to the upper barrel's axis. The lower two light generators 42 combine to create an intersection line 46, which is aligned to the lower barrel's axis. The first intersection line 46 is vertically offset from the second intersection line 48. The first intersection line is associated with a projectile's path, corresponding to the projectile fired by the lower barrel, while the second intersection line is associated with a second projectile's path, corresponding to the projectile fired by the upper barrel. The control facility 54 is operable to selectively operate either the first pair 42 or the second pair 44 of planar lights, depending on which barrel the user wishes to discharge. This embodiment also includes a plurality of LEDs to serve as flashlights 90. It should be appreciated that the planar and non-planar lights and light emitted by the LED flashlights can be any desired wavelength or combination of wavelengths, including both visible and invisible wavelengths.

FIG. 7 illustrates projected shapes against a target surface 30 resulting from a variety of embodiments of the improved aiming apparatus 10, 300, 400, and 500 for a firearm. Each embodiment includes a plurality of planar and non-planar light generators 24 and shaping optics 40 types and positions, typically arranged in pairs. As is shown, the lights emitted by the light generators and associated shaping optics can be flat planes 34 creating flat lines 32 on target surfaces 30, or curved non-planar features 36 creating curved lines 38 on target surfaces 30.

FIG. 8 illustrates a second alternative embodiment of the improved aiming apparatus 200 for a firearm 12 of the present invention, and FIG. 9 illustrates how the improved aiming apparatus 200 increases accuracy throughout the target zone defined by projectile path 56. The aiming apparatus 200 for a firearm includes a frame 222 that is attached to the picatinny rail 72 of a firearm 12 by a rail interface region 270. A plurality of light generators 24 and shaping optics 40 are connected to the frame. Each of the light generators is operable to project planar light 26 in the forward direction. The light generators include a first pair 42 operable to generate a first intersection line 46 and a second pair of light generators 44 operable to generate a second intersection line 48, which is different from the first intersection line. The first intersection line is vertically offset from the second intersection line. The first intersection line is associated with the projectile path 56 over a first range of distances 50, and the second intersection line is associated with the projectile path over a second range of distances 52. The light generators also include a third pair 66 operable to generate a third intersection line 68 different and vertically offset from the first and second intersection lines. The third intersection line is associated with the projectile path over a third range of distance 64. The control facility 54 enables the operator to selectively energize either the first pair 42, the second pair 44, or the third pair 66 of light generators based on the distance to target surface 30. The ability to select which set of light generators is operated in a stairstep targeting system ensures the light projected against a target surface will provide greater point of impact accuracy than the prior art. Furthermore, the ability to better approximate the curved projectile path using stepped intersection lines resulting from multiple pairs of light generators increases the distance defined by the target zone and decreases the size of the "warning zone" that the target is too close for adequate reaction time. It should also be appreciated that the three intersection lines do not have to be parallel to each other. The first intersection line could be angled upwards, the second intersection line could be horizontal, and the third intersection line could be angled downwards to create a polygonal approximation of the projectile path instead of a stepped approximation.

The control facility 54 can also include a range finder 96 to measure the distance to target surface 30 and the capability of automatically selecting which pair of light generators 42, 44, 66 to operate based on the measured distance to best approximate the projectile path 56 at the measured distance. The range finder could also be used to calibrate a selected pair of light generators for a specific distance.

FIG. 10 illustrates a third alternative embodiment of the improved aiming apparatus 600 for a firearm 12 of the present invention. The aiming apparatus 600 for a firearm includes a frame 622 that is attached to the picatinny rail 72 of a firearm by a rail interface region 670. A plurality of light generators 24 and motorized shaping optics 78 are connected to the frame. Each of the planar light generators is operable to project planar light 26 in a forward direction. The motorized shaping optics 78 are oriented with the planar lights in a non-parallel relationship to each other and are aligned to the exit point of the muzzle axis 98. After the operator inputs the projectile performance data and the distance of the firearm's zero point, the control facility 54 can then use the range finder 96 and windage readings to adjust the planar lights 26 clockwise or counterclockwise, which in turn will relocate the intersection line 28 up, down, left and/or right relative to the intersection line's original starting point. This capability enables the intersection line's location to be located precisely at the projectile's point of impact, at any distance throughout the entire target zone.

FIG. 11 in conjunction with FIG. 3 illustrates an associated application and how the improved aiming apparatus 600, along with the projectile performance data, adjusts the projected intersection location through the use of range finder and windage sensor readings to provide precise projectile impact location throughout the target zone as defined by projectile path 154. Based on user input of projectile performance data 150, the distance the firearm is zeroed to 152, and the distance the planar lights 26 have to travel to start crossing 58, the application calculates the projectile trajectory 154, the projectile apex 156 of that trajectory, and the "warning zone" 158. Using the range finder, the application screen provides distance readings and vertical intersection adjustments 160 to realign the intersection line's 28 location, keeping the intersection line's point of impact 62 on the projectile path for that specific distance 162. Once the firearm is discharged, the projectile performance data is logged 164, target distance readings and intersection vertical adjustments are logged 166, and target location along the projectile trajectory is marked 168. Based on wind readings, the control facility 54 can automatically adjust the intersection location 170 to compensate for projectile drift at a specific distance. The operator can manually adjust the intersection location up, down, left, or right in increments of a specified resolution 172.

The associated application illustrated in FIG. 11 can be connected to the improved aiming apparatus 600 via USB data cable, or Bluetooth, or other suitable methods of data transfer. Law enforcement and military units have an accelerometer and GPS unit options, allowing the control facility to log the time, date and GPS location of every round fired.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of an aiming apparatus for a firearm has been described in detail, it should be apparent that modifications and variations thereto are possible, all of which fall within the true spirit and scope of the invention. Although pistols and shotguns have been disclosed, the aiming apparatus for a firearm is also suitable for use with rifles, light and medium machine guns, and other firearms. With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An aiming apparatus for a firearm having a barrel defining a barrel axis and terminating in a muzzle at a forward end, the apparatus comprising:

a frame;

a plurality of beam generators connected to the frame;

each of the beam generators operable to project in the forward direction a planar beam;

the beam generators oriented with the planar beams in a non-parallel relationship in which the planar beams intersect along an intersection line extending in the forward direction; and wherein the intersection line is angularly offset from the bore axis.

2. The aiming apparatus for a firearm of claim 1 wherein when projected against a target surface, the planar beams generate a projected cross shape having an intersection point.

3. The aiming apparatus for a firearm of claim 2 wherein the intersection point is on the intersection line.

4. The aiming apparatus for a firearm of claim 1 wherein the planar beams are flat planes.

5. The aiming apparatus for a firearm of claim 1 wherein the planar beams are curved planes, and the intersection line is a curve.

6. The aiming apparatus for a firearm of claim 1 wherein the intersection line is aligned with the barrel axis.

7. The aiming apparatus for a firearm of claim 1 wherein the intersection line when drawn back to a transverse plane defined by the muzzle intersects the transverse plane at a location closer to the barrel axis than are the beam generators.

8. The aiming apparatus for a firearm of claim 1 wherein the beam generators are both at a level below the barrel.

9. The aiming apparatus for a firearm of claim 1 wherein the beam generators comprise a first pair operable to generate a first intersection line, and including a second pair of beam generators operable to generate a second intersection line different from the first intersection line.

10. The aiming apparatus for a firearm of claim 9 wherein the first intersection line is vertically offset from the second intersection line.

11. The aiming apparatus for a firearm of claim 9 wherein the first intersection line is associated with a bullet path over a first range of distances, and the second intersection line is associated with a bullet path over a second range of distances.

12. The aiming apparatus for a firearm of claim 11 including a control facility operable to selectively operate either the first pair or the second pair based on a distance of a target.

13. The aiming apparatus for a firearm of claim 1 wherein the beam generators are rotatable to adjustably select the position of the intersection line with respect to the barrel axis.

14. The aiming apparatus for a firearm of claim 13 wherein the planar beams are adjustable to select the lateral offset of the intersection line.

15. The aiming apparatus for a firearm of claim 1 wherein the intersection line is offset from the beam generators.

16. The aiming apparatus for a firearm of claim 1 wherein at least one of the planar beams is conical.

17. The aiming apparatus for a firearm of claim 1 wherein the intersection line intersects the barrel axis.

18. An aiming apparatus for a firearm having a barrel defining a barrel axis and terminating in a muzzle at a forward end, the apparatus comprising:

a frame;

a plurality of beam generators connected to the frame;

each of the beam generators operable to project in the forward direction a planar beam;

the beam generators oriented with the planar beams in a non-parallel relationship in which the planar beams intersect along an intersection line extending in the forward direction; and wherein the beam generators are below the barrel, the firearm defines a curved bullet path initially extending on the barrel axis and curving downward, and wherein the intersection line intersects the bullet path at an intersection point, and is above the bullet path rearward of the intersection point.

19. An aiming apparatus for a firearm having a barrel defining a barrel axis and terminating in a muzzle at a forward end, the apparatus comprising:

a frame;

a plurality of beam generators connected to the frame;

each of the beam generators operable to project in the forward direction a planar beam;

the beam generators oriented with the planar beams in a non-parallel relationship in which the planar beams intersect along an intersection line extending in the forward direction; and wherein the firearm defines a curved bullet path initially extending on the barrel axis and curving downward, and wherein the intersection line intersects the bullet path at two intersection points.

20. The aiming apparatus for a firearm of claim 1 wherein the intersection line is angled downward below the bore axis.

* * * * *